US006688844B2

(12) United States Patent
Yu

(10) Patent No.: US 6,688,844 B2
(45) Date of Patent: Feb. 10, 2004

(54) AUTOMOTIVE FUEL PUMP IMPELLER

(75) Inventor: DeQuan Yu, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/045,739

(22) Filed: Oct. 29, 2001

(65) Prior Publication Data

US 2003/0082047 A1 May 1, 2003

(51) Int. Cl.[7] ..... F04D 5/00

(52) U.S. Cl. ..... 415/55.1; 415/169.1; 416/241 A; 417/423.3

(58) Field of Search ..... 415/55.1–55.7, 415/169.1, 169.2, 186, 187, 208.5; 416/241 A, 237, 236 R; 417/423.3, 423.14

(56) References Cited

U.S. PATENT DOCUMENTS

| | | | | |
|---|---|---|---|---|
| 3,135,215 A | * | 6/1964 | Smith | |
| 3,405,644 A | * | 10/1968 | Skinner | |
| 4,325,672 A | * | 4/1982 | Sixsmith et al. | 415/53 T |
| 4,793,766 A | * | 12/1988 | Kumata | 415/53 |
| 5,011,367 A | | 4/1991 | Yoshida et al. | |
| 5,096,386 A | * | 3/1992 | Kassel | 417/69 |
| 5,299,908 A | * | 4/1994 | Robbie | 415/55.1 |
| 5,348,442 A | * | 9/1994 | Harris et al. | 415/55.1 |
| 5,372,475 A | | 12/1994 | Kato et al. | |
| 5,409,357 A | | 4/1995 | Yu et al. | |
| 5,509,778 A | * | 4/1996 | Hantle et al. | 415/55.1 |
| 5,513,950 A | | 5/1996 | Yu | |
| 5,527,149 A | | 6/1996 | Moss et al. | |
| 5,599,163 A | * | 2/1997 | Heath et al. | 415/55.1 |
| 5,702,229 A | * | 12/1997 | Moss et al. | 415/55.4 |
| 6,113,363 A | | 9/2000 | Talaski | |
| 6,152,687 A | * | 11/2000 | Wilhelm et al. | 415/55.1 |
| 6,174,128 B1 | | 1/2001 | Yu | |
| 6,527,505 B2 | * | 3/2003 | Yu et al. | 415/55.1 |

FOREIGN PATENT DOCUMENTS

| | | |
|---|---|---|
| EP | 931 927 A1 | 7/1999 |
| EP | 1 028 256 A3 | 8/2000 |
| EP | 1 028 256 A2 | 8/2000 |

* cited by examiner

*Primary Examiner*—Edward K. Look
*Assistant Examiner*—J. M. McAleenan
(74) *Attorney, Agent, or Firm*—Brinks Hofer Gilson & Lione

(57) ABSTRACT

An impeller for a fuel pump includes an impeller body having a substantially disk shape. A plurality of radially outwardly extending vanes extend from the impeller body with a plurality of partitions interposed therebetween. The partitions and the vanes define a plurality of vane grooves each including an inlet portion, an exit portion and an arcuate shaped portion interconnecting the inlet portion and the exit portion. The inlet portion of each of the vane grooves has a straight section which is substantially perpendicular to and extends inward from an adjacent face. The vane grooves extend inward from the inlet portion such that the exit portions of two aligned vane grooves define a vane groove tip. The exit portion of each of the vane grooves includes a straight section such that the straight sections of two aligned exit portions define an included angle therein.

24 Claims, 4 Drawing Sheets

AUTOMOTIVE FUEL PUMP IMPELLER

TECHNICAL FIELD OF THE INVENTION

The present invention generally relates to automotive fuel pumps, and more particularly to a regenerative turbine type rotary impeller.

BACKGROUND OF THE INVENTION

Regenerative fuel pumps have been widely used in automotive applications because of the low specific speed number (ratio of diameter and flow rate vs. pressure), quiet operation, good hot fuel handling and durability. Since the regenerative fuel pump was first introduced, there is typically a "dead zone" area in the top of the vane grooves. Therefore, there is a need for improvements to the impeller of a regenerative turbine fuel pump.

DETAILED DESCRIPTION OF THE INVENTION

The following description of the preferred embodiment of the invention is not intended to limit the scope of the invention to this preferred embodiment, but rather to enable any person skilled in the art to make and use the invention.

Figure 1:
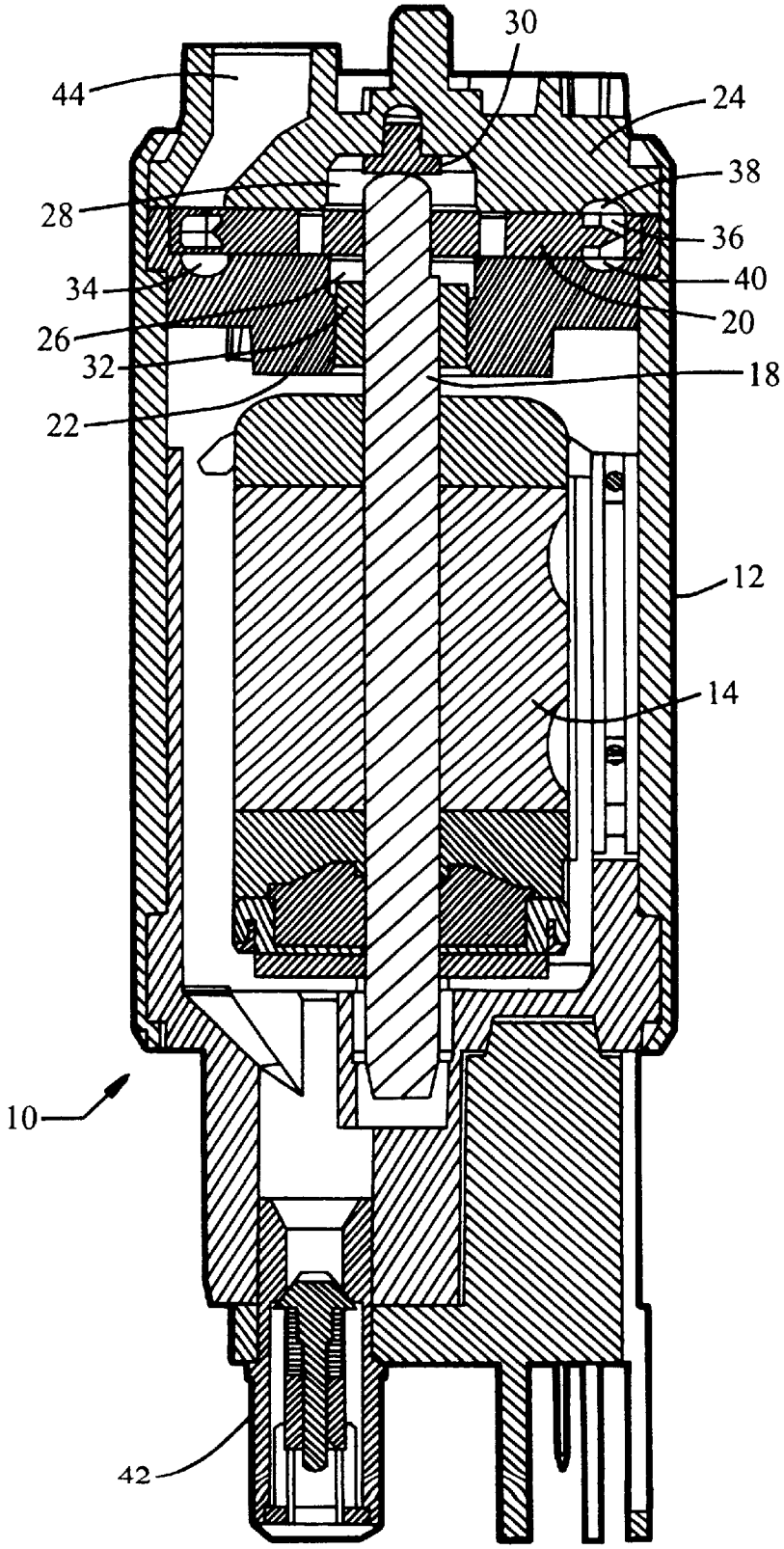
FIG. 1 is a sectional view of a fuel pump of the present invention.

Referring to FIG. 1, a fuel pump of the present invention is generally shown at 10. The fuel pump 10 includes a housing 12 and a motor 14 mounted within the housing 12. Preferably, the motor 14 is an electric motor with a shaft 18 extending therefrom. An impeller 20 is fitted onto the shaft 18 and is encased within the pump housing 12 between a pump bottom 22 and a pump cover 24. The impeller 20 has a central axis which is coincident with the axis of the shaft 18. The shaft 18 passes through a shaft opening 26 in the pump bottom 22, through the impeller 20, into a cover recess 28, and abuts a thrust button 30. The shaft 18 is journalled within a bearing 32. A pumping chamber 36 is formed along the periphery of the impeller 20 by an annular cover channel 38 of the pump cover 24 and an annular bottom channel 40 of the pump bottom 22. The pump bottom 22 has a fuel outlet 34 leading from the pumping chamber 36. Pressurized fuel is discharged through the fuel outlet 34 to and cools the motor 14 while passing over the motor 14 to a pump outlet 42 at an end of the pump 10 which is axially opposite a fuel inlet 44.

Figure 2:
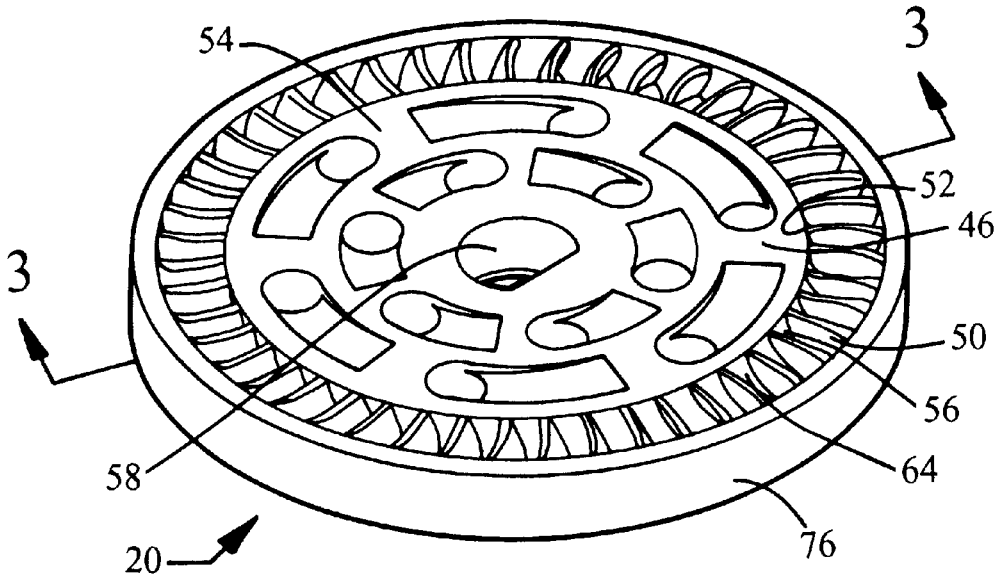
FIG. 2 is a perspective view of an impeller of the fuel pump of FIG. 1.
Figure 3:
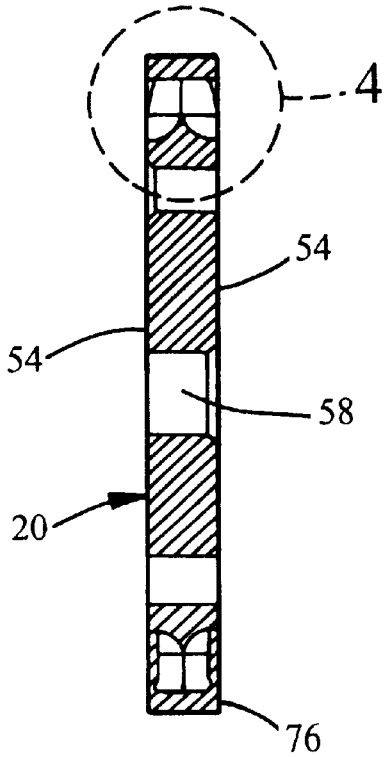
FIG. 3 is a sectional view of the impeller shown in FIG. 2.

Referring to FIG. 2, a perspective view of the impeller 20 is shown. FIG. 3 shows a sectional view of the impeller 20 along line 3—3 of FIG. 2. The impeller 20 has an impeller body 46 which is substantially disk shaped. Preferably, the impeller 20 is symmetrical about a plane passing through the impeller 20. The impeller body 46 includes a plurality of vanes 50 extending radially outward from an outer circumference 52 of the impeller face 54. Partitions 56 are interposed between the vanes 50 to circumferentially separate the vanes 50. The partitions 56 extend radially outward from the outer circumference 52 a radially shorter distance than the vanes 50. A bore 58 is formed so the impeller 20 can be slip fit to the shaft 18.

Referring to FIG. 4, a detailed partial cross-sectional view of an outer circumferential portion of impeller 20 through a partition 56 is shown. The vane 50, which preferably is rectangular shaped, adjoins the partition 56. The vanes 50 and the partitions 56 define a plurality of vane grooves 64 extending around the impeller 20. The vane grooves 64 are thus axially separated by the partitions 56. Each of the vane grooves 64 includes an inlet portion 66 adjacent one of the faces 54, an exit portion 68 and an arcuate shaped portion 60 interconnecting the inlet portion 66 and the exit portion 68. The arcuate portions 60 begin at the outer circumference 52 of the impeller face 54 and preferably are quarter-circle shaped.

The inlet portion 64 of each of the vane grooves 64 has a straight section 70 which is substantially perpendicular to the adjacent face 54 and extends inward from the adjacent face 54. Preferably, the straight section 70 of the inlet portion 66 extends inward from the adjacent face 54 a distance 71 between roughly 0.05 millimeters and roughly 0.3 millimeters. In the first and second preferred embodiments, the straight section 70 of the inlet portion 66 extends inward 0.12 millimeters. The straight section 70 of the inlet portion 66 allows the flow to stabilize which significantly reduces the amount of turbulence in the flow which testing has shown improves the pumping chamber 36 efficiency by roughly 10 percent.

Figure 6:
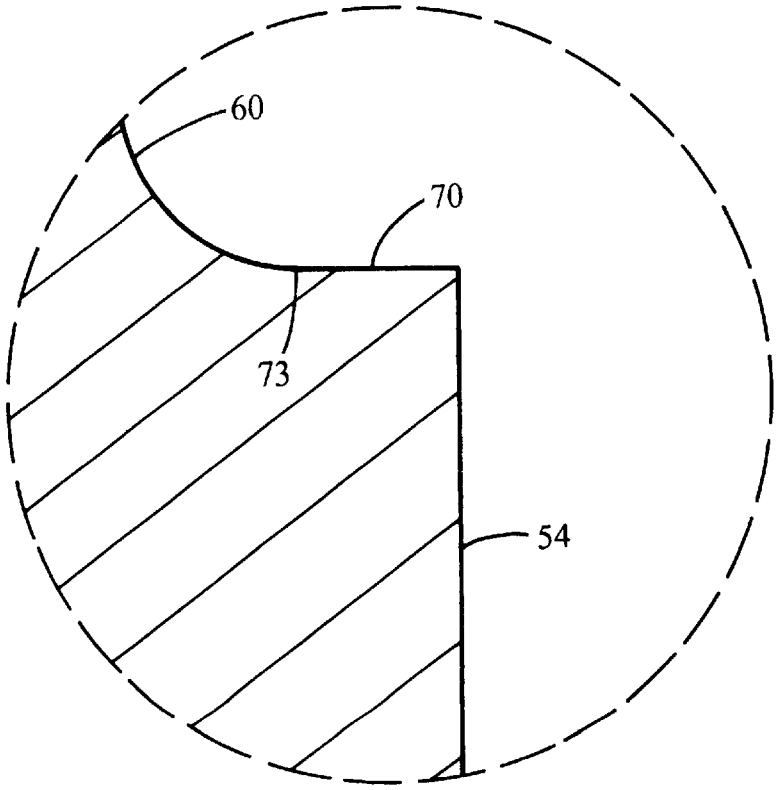
FIG. 6 is a close-up sectional view of a portion of the embodiment seen in FIG. 5.

A transition section 73 is located between the arcuate portion 60 of the vane groove 64 and the straight section 70. Referring to FIG. 6, the transition section 73 is defined by the point where the arcuate section 60 ends and the straight section 70 begins. Preferably, the transition section 73 is located a distance 71 between roughly 0.05 millimeters and roughly 0.3 millimeters from the adjacent face. In the first and second preferred embodiments, the transition section 73 is 0.12 millimeters from the adjacent face.

Figure 4B:
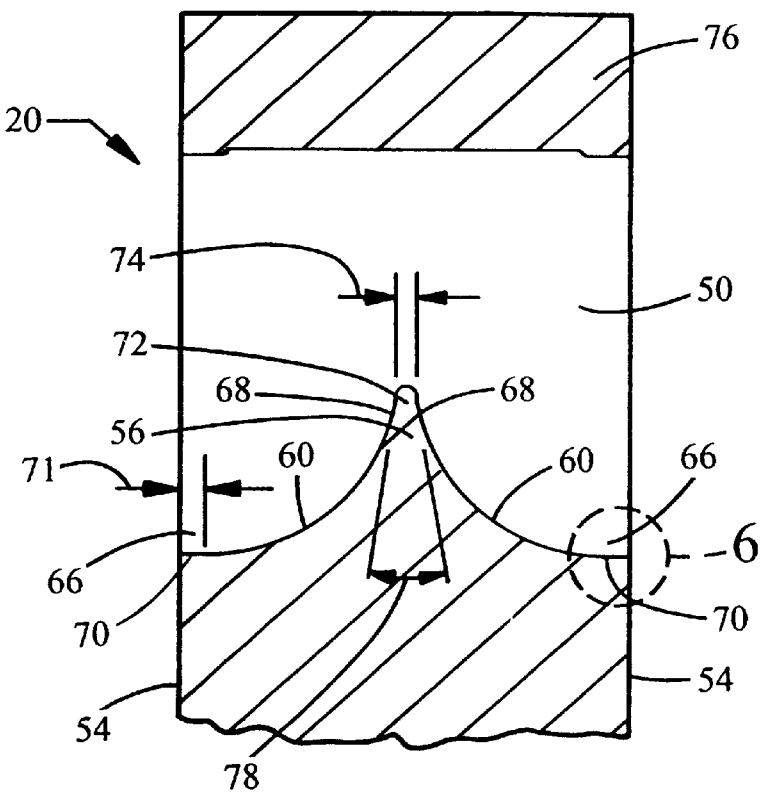
FIG. 4*b* is a close-up view of a portion of the sectional view of FIG. 3 shown with a curved vane groove tip.
Figure 4A:
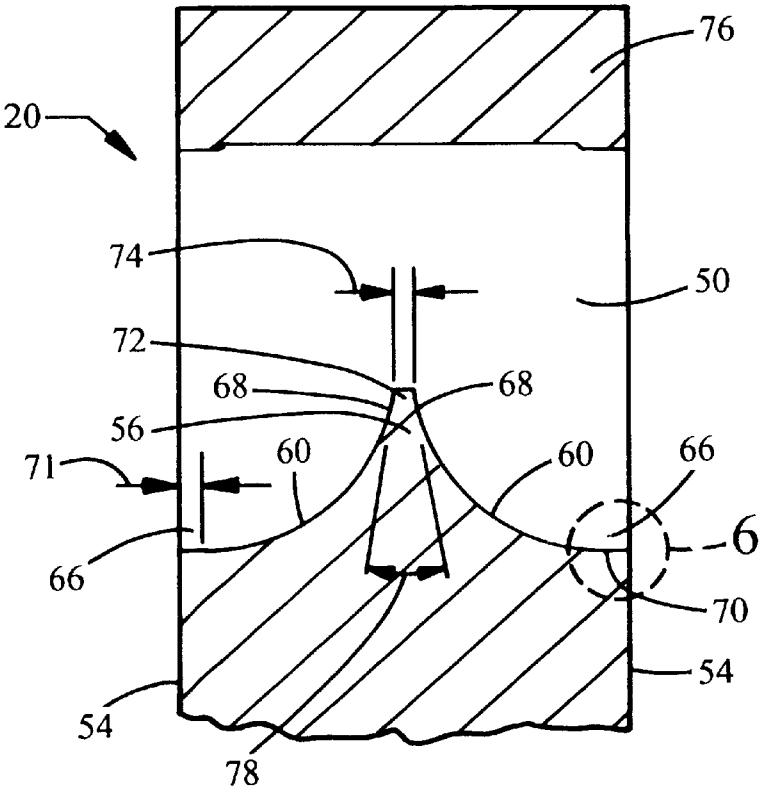
FIG. 4*a* is a close-up view of a portion of the sectional view of FIG. 3 shown with a flat vane groove tip.

The arcuate portions 60 of the vane grooves 64 extend inward and radially outward from the impeller 20. The exit portions 68 of two aligned vane grooves 64 define a vane groove tip 72. Preferably, the vane groove tip 72 has a thickness 74 of between roughly 0.05 millimeters and 0.2 millimeters. In the preferred embodiments, the vane groove tip 72 has a thickness of 0.12 millimeters. The vane groove tip 72 can be flat as shown in FIG. 4*a*, or have a curved shape to it as shown in FIG. 4*b*. The thickness 74 of the vane groove tip 72 of the present invention eliminates the dead zone in the top of the vane grooves 64 which has been experienced in conventional regenerative turbine fuel pumps.

The exit portion 68 of each of the vane grooves 64 also includes a straight section such that the straight sections of two aligned exit portions define an included angle 78. Preferably, the included angle 78 between the straight sections of two aligned exit portions 68 is between roughly zero degrees and roughly 15 degrees. In the preferred embodiments, the included angle 78 is less than 5 degrees.

Figure 5:
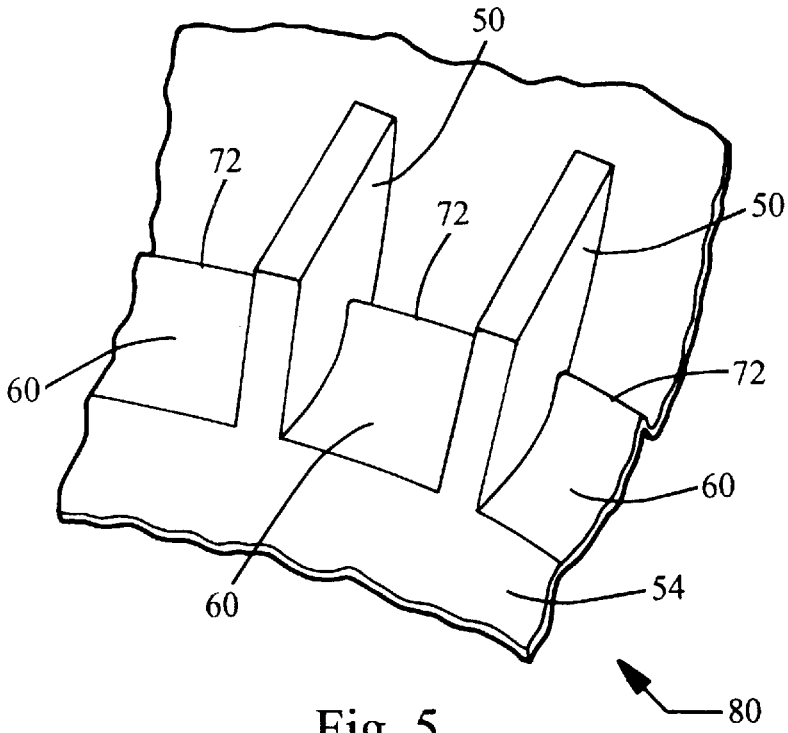
FIG. 5 is a partial perspective view of a second preferred embodiment.

As shown in FIGS. 1 through 4, the first preferred embodiment of the impeller includes a ring portion 76 around the outer circumference 52 connected to the vanes 50. The ring portion 76 fits snugly within the pumping chamber 36 so the pump bottom 22 does not require a stripper portion (not shown), as is required in conventional fuel pumps employing regenerative turbine type impellers. Referring to FIG. 5, a portion of a second preferred embodiment of the impeller is shown generally at 80. The second preferred embodiment 80 does not include the ring portion 76. It is to be understood that the features of the present invention could be applied just as effectively to an impeller without a ring portion 76. A plurality of axially extending fuel flow passages 78 are formed between the vanes 50, the partitions 56, and the ring portion 76.

The impeller 20 is preferably injection molded from a plastic material, such as phenolic, acetyl or other plastics. It is to be understood that the impeller 20 could also be made from non-plastic materials known to those skilled in the art such as aluminum or steel. The fuel pump 10 can be mounted within a fuel tank (not shown) or, alternatively, can be mounted in-line between the fuel tank and the engine of the vehicle.

The foregoing discussion discloses and describes two preferred embodiments of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

What is claimed is:

1. An impeller for a fuel pump for supplying fuel to an automotive engine from a fuel tank comprising:

an impeller body having a substantially disk shape with opposing faces and an outer circumference;

a plurality of radially outwardly extending vanes extending from said outer circumference of said impeller body and;

a plurality of partitions interposed therebetween extending a radially shorter distance than said vanes, said partitions and said vanes defining a plurality of vane grooves;

each of said vane grooves including an inlet portion adjacent one of said faces, an exit portion and an arcuate shaped portion or portions interconnecting said inlet portion and said exit portion;

said inlet portion of each of said vane grooves having a straight section substantially perpendicular to said adjacent face and extending inward from said adjacent face;

said vane grooves extending inward from said inlet portion wherein said exit portions of two aligned vane grooves define a vane groove tip; said exit portion of each of said vane grooves including a straight section wherein said straight sections of two aligned exit portions define an included angle that is less than about 15 degrees.

2. The impeller of claim 1, wherein the included angle between said straight sections of two aligned exit portions is less than 5 degrees.

3. The impeller of claim 1 wherein said impeller is symmetrical about a plane through said impeller.

4. The impeller of claim 1 wherein said vane groove tip is substantially flat.

5. The impeller of claim 1 wherein said vane groove tip is substantially curved.

6. The impeller of claim 1 further including a ring portion extending circumferentially around said impeller and being attached to distal ends of said plurality of vanes.

7. An impeller for a fuel pump for supplying fuel to an automotive engine from a fuel tank comprising:

an impeller body having a substantially disk shape with opposing faces and an outer circumference;

a plurality of radially outwardly extending vanes extending from said outer circumference of said impeller body and;

a plurality of partitions interposed therebetween extending a radially shorter distance than said vanes, said partitions and said vanes defining a plurality of vane grooves;

each of said vane grooves including an inlet portion adjacent one of said faces, an exit portion and an arcuate shaped portion or portions interconnecting said inlet portion and said exit portion;

said inlet portion of each of said vane grooves having a straight section substantially perpendicular to said adjacent face and extending inward from said adjacent face a distance between about 0.05 millimeters and about 0.3 millimeters;

said vane grooves extending inward from said inlet portion wherein said exit portions of two aligned vane grooves define a vane groove tip; said exit portion of each of said vane grooves including a straight section wherein said straight sections of two aligned exit portions define an included angle therein.

8. The impeller of claim 7 wherein said straight section of said inlet portion extends inward from said adjacent face 0.12 millimeters.

9. The impeller of claim 7 wherein said impeller is symmetrical about a plane through said impeller.

10. The impeller of claim 7 wherein said vane groove tip is substantially flat.

11. The impeller of claim 7 wherein said vane groove tip is substantially curved.

12. The impeller of claim 7 further including a ring portion extending circumferentially around said impeller and being attached to distal ends of said plurality of vanes.

13. An impeller for a fuel pump for supplying fuel to an automotive engine from a fuel tank comprising:

an impeller body having a substantially disk shape with opposing faces and an outer circumference;

a plurality of radially outwardly extending vanes extending from said outer circumference of said impeller body and;

a plurality of partitions interposed therebetween extending a radially shorter distance than said vanes, said partitions and said vanes defining a plurality of vane grooves;

each of said vane grooves including an inlet portion adjacent one of said faces, an exit portion and an arcuate shaped portion or portions interconnecting said inlet portion and said exit portion;

said inlet portion of each of said vane grooves having a straight section substantially perpendicular to said adjacent face and extending inward from said adjacent face, and a transition section between said straight section of said inlet and said arcuate shaped portion, said transition section being located between about 0.05 millimeters and about 0.3 millimeters from said adjacent faces;

said vane grooves extending inward from said inlet portion wherein said exit portions of two aligned vane grooves define a vane groove tip; said exit portion of each of said vane grooves including a straight section wherein said straight sections of two aligned exit portions define an included angle therein.

14. The impeller of claim 13 wherein said transition section is located 0.12 millimeters from said adjacent face.

15. The impeller of claim 13 wherein said impeller is symmetrical about a plane through said impeller.

16. The impeller of claim 13 wherein said vane groove tip is substantially flat.

17. The impeller of claim 13 wherein said vane groove tip is substantially curved.

18. The impeller of claim 13 further including a ring portion extending circumferentially around said impeller and being attached to distal ends of said plurality of vanes.

19. An impeller for a fuel pump for supplying fuel to an automotive engine from a fuel tank comprising:

an impeller body having a substantially disk shape with opposing faces and an outer circumference;

a plurality of radially outwardly extending vanes extending from said outer circumference of said impeller body and;

a plurality of partitions interposed therebetween extending a radially shorter distance than said vanes, said partitions and said vanes defining a plurality of vane grooves;

each of said vane grooves including an inlet portion adjacent one of said faces, an exit portion and an arcuate shaped portion or portions interconnecting said inlet portion and said exit portion;

said inlet portion of each of said vane grooves having a straight section substantially perpendicular to said adjacent face and extending inward from said adjacent face;

said vane grooves extending inward from said inlet portion wherein said exit portions of two aligned vane grooves define a vane groove tip having a thickness of between about 0.05 millimeters and about 0.2 millimeters;

said exit portion of each of said vane grooves including a straight section wherein said straight sections of two aligned exit portions define an included angle therein.

20. The impeller of claim 19 wherein said vane groove tip has a thickness of 0.12 millimeters.

21. The impeller of claim 19 wherein said impeller is symmetrical about a plane through said impeller.

22. The impeller of claim 19 wherein said vane groove tip is substantially flat.

23. The impeller of claim 19 wherein said vane groove tip is substantially curved.

24. The impeller of claim 19 further including a ring portion extending circumferentially around said impeller and being attached to distal ends of said plurality of vanes.

* * * * *

UNITED STATES PATENT AND TRADEMARK OFFICE

CERTIFICATE OF CORRECTION

PATENT NO. : 6,688,844 B2
DATED : February 10, 2004
INVENTOR(S) : DeQuan Yu

It is certified that error appears in the above-identified patent and that said Letters Patent is hereby corrected as shown below:

Column 4,
Line 22, after “adjacent” delete “faces;” and substitute -- face; -- in its place.

Signed and Sealed this

Twenty-ninth Day of June, 2004

JON W. DUDAS
*Acting Director of the United States Patent and Trademark Office*